US005701570A

United States Patent [19]

Takuma

[11] Patent Number: 5,701,570

[45] Date of Patent: Dec. 23, 1997

[54] IMAGE FORMING APPARATUS EMPLOYING RESIDUAL TONER RECOVERY SCHEME

[75] Inventor: Yasuo Takuma, Hitachi, Japan

[73] Assignees: Hitachi, Ltd.; Hitachi Koki Co., Ltd., both of Tokyo, Japan

[21] Appl. No.: 565,348

[22] Filed: Nov. 30, 1995

[30] Foreign Application Priority Data

Dec. 13, 1994 [JP] Japan ..... 6-308642

[51] Int. Cl.[6] ..... G03G 15/00; G03G 21/00

[52] U.S. Cl. ..... 399/343; 399/149; 399/349; 399/358

[58] Field of Search ..... 355/269, 296, 355/297; 399/148, 150, 149, 349, 343, 357, 358; 15/1.51

[56] References Cited

U.S. PATENT DOCUMENTS

| | | | |
|---|---|---|---|
| 4,469,435 | 9/1984 | Nosaki et al. | 399/148 |
| 5,066,982 | 11/1991 | Hosoya et al. | 355/269 |
| 5,124,757 | 6/1992 | Ikegawa | 355/296 |
| 5,321,471 | 6/1994 | Ito et al. | 355/269 X |
| 5,438,397 | 8/1995 | Okano et al. | 355/269 |
| 5,541,717 | 7/1996 | Saito et al. | 355/269 |
| 5,587,774 | 12/1996 | Nagahara et al. | 399/150 X |
| 5,606,408 | 2/1997 | Yano et al. | 399/343 |

FOREIGN PATENT DOCUMENTS

| | | |
|---|---|---|
| 52-23348 | 2/1977 | Japan . |
| 5-210300 | 8/1993 | Japan . |
| 6-51672 | 2/1994 | Japan . |
| 6-68666(B2) | 8/1994 | Japan . |

*Primary Examiner*—Arthur T. Grimley
*Assistant Examiner*—Sophia S. Chen
*Attorney, Agent, or Firm*—Antonelli, Terry, Stout & Kraus, LLP.

[57] ABSTRACT

So as to realize an image forming apparatus capable of withstanding a long period of practical use and which does not waste toners, an image forming apparatus is provided having a cleaning roller and a reverse charge promoting member which applies a bias having a reverse polarity to residual toners which have remained on a photoconductor, a charger unit for establishing the charge polarity of the toners to the same polarity as the surface of the photoconductor, and a developer roller to which is applied a bias voltage to enable the rollers to recover the toners on the photoconductor. In the image forming apparatus, there is a cleaner unit having a simplified construction in which there is a minimum of the waste of toners, and further, since in the image forming process the toners are efficiently discharged from the cleaner unit, the lowering of the cleaning performance hardly occurs.

14 Claims, 7 Drawing Sheets

IMAGE FORMING APPARATUS EMPLOYING RESIDUAL TONER RECOVERY SCHEME

BACKGROUND OF THE INVENTION

The present invention relates to an image forming apparatus and particularly to an image forming apparatus, such as a printing machine, a facsimile machine, and a copying machine, in which toners are used to form an image on a recording medium.

The present invention relates to an image forming apparatus having a cleaner unit and a developer unit and particularly to an image forming apparatus having a cleaner unit and a developer unit in which toners are used to form an image on a recording medium, the cleaner unit including a cleaning roller and a reversal charge promoting member, wherein residual toners are recovered by the developer unit.

In a conventional image forming apparatus, after a toner image formed on a photoconductor as an image bearing body is transferred to a recording medium, such as a printing sheet, a cleaner unit is provided so as to remove residual toners which remain on the photoconductor.

A cleaner unit in the form of a bias cleaner unit for an image forming apparatus, for example, is disclosed in Japanese patent publication No. Hei 6-68666. In this bias cleaner unit, the toners are cleaned by applying a voltage to a cleaning brush member provided in the cleaner unit of the image forming apparatus.

In the conventional cleaner unit of an image forming apparatus, a bias power supply, which has a reverse polarity with respect to the toner electrical charge, is connected to a brush roller. The toners which have adhered to the brush roller on an adhered surface of the brush roller. When the toners have settled on the brush roller, the brushes of the brush roller tend to become clogged over a long period of use, and thereby the cleaning performance of the image forming apparatus is adversely affected.

For the above stated reason, it is necessary to dislodge the accumulated toners from the brush roller. By producing contact under pressure between a fixing member and the brush roller, however, to dislodge the toner therefrom, an abrasion on the brushes of the brush roller results in a rapid wearing of the brushes.

As a result, a metal roller has been arranged in proximity to the brush roller, and this metal roller rotates in contact with the brush roller. The bias power supply is connected to the above stated metal roller and this bias power supply has an absolute value of a higher potential to that of another bias power supply which is applied to the brush roller.

The toners are electrostatically transferred from the brush roller to the metal roller according to the difference in potential between the potential of the brush roller and the potential of the metal roller. After that, the toners are scratched from the metal roller by a blade plate member which is fixed in contact with the metal roller.

Further, a method of cleaning a photoconductor of an image forming apparatus has been disclosed, for example, in Japanese patent laid-open publication No. Sho 52-23348.

In this cleaning method, an electric charge is applied to a part of the photoconductor at a time when an image formation of the photoconductor is not performed, and according to this given electric charge, the toners which adhere to a magnetic brush for cleaning are absorbed, thereby the absorbed toners adhere to the above part.

The toners which have adhered to the above part are transferred to the development position with the rotation of the photoconductor. Before the above part reaches the development position, the above part is electrically discharged. After that, in the vicinity of the development position, the toners are separated from the above part and these toners are recovered in a developer unit.

Further, another conventional image forming apparatus is disclosed, for example in Japanese patent publication laid-open No. Hei 5-210300. In this conventional image forming apparatus, a cleaning roller is provided between a transfer unit and a charging roller so as to contact a photoconductor.

By the provision of the above cleaning roller, the remaining toners are first absorbed on the cleaning roller, and in company with the rotation of the cleaning roller, the toners are returned little by little to the photoconductor.

As stated above, in a cleaner unit which is disposed for a long period of practical use in an image forming apparatus, since the cleaner unit itself becomes large, and many constituting members are necessary, it is unsuitable for use in an image forming apparatus of compact size and low cost. Further, from an aspect of the ecology, recently it has become necessary to provide an image forming apparatus from which no waste toners are produced.

SUMMARY OF THE INVENTION

An object of the present invention is to provide an image forming apparatus wherein the construction of the image forming apparatus can be simplified and the image forming apparatus can be constituted to suit compact size.

Another object of the present invention is to provide an image forming apparatus wherein toners are finally recovered in a developer unit of the image forming apparatus.

A further object of the present invention is to provide an image forming apparatus wherein toners can be reused in the image forming apparatus, so that wasted toners are not produced by the image forming apparatus.

A further object of the present invention is to provide an image forming apparatus which is capable of a long period of practical use.

A further object of the present invention is to provide an image forming apparatus which is capable of attaining a long period of practical use, in contrast to the problem in the above stated prior art, the image forming apparatus having a compact cleaner unit in which waste toners are not discharged from the image forming apparatus.

According to the present invention, an image forming apparatus has a charger unit for uniformly charging a surface of an image bearing body, an exposure unit for light-irradiating a surface of the charged image bearing body and for forming an electrostatic latent image thereon, a developer unit having a development roller for supplying toners having a predetermined electric charge on the electrostatic latent image and for forming a visual image, the developer unit having a development roller capable of receiving toners present on the image bearing body so as to recover residual toners from the said image bearing body to the developer unit and being supplied with a bias voltage, a transfer unit for transferring the visual image from the image bearing body onto a recording medium, and a cleaner unit for cleaning toners which remain on the image bearing body after the transfer of the visual image on the recording medium, the cleaner unit having a cleaning roller and a reversal charge promoting member.

The image forming apparatus comprises a bias power supply for supplying a reverse polarity to the development unit during an image non-forming time with respect to the polarity applied during the printing time and with respect to the bias voltage applied to the cleaning roller, and the cleaner unit further includes means for reversing the electric charge polarity of the residual toners present on the image bearing body, whereby the electric charge polarity of the cleaner unit is reversed and, in company with the rotation of the image bearing body, the discharging toners from the image bearing body are introduced to the developer unit and recovered in the developer unit.

According to the present invention, an image forming apparatus comprises mainly a photoconductor, a cleaner unit basically constituted of a cleaning roller and a reversal charge promoting member, a charger unit, a developing roller, and a bias power supply.

In the cleaner unit of the image forming apparatus according to the present invention, the cleaning roller is supplied with a polarity opposite to a charge polarity of the toners which remain on the photoconductor after completion of the transfer process during the image formation. The reversal charge promoting member is adjacently arranged or contacted to the cleaning roller of the cleaner unit.

The charger unit of the image forming apparatus is arranged to have the same charge polarity on the toners on the photoconductor extending from the cleaner unit to the developer unit as the charge polarity on the surface of the photoconductor itself. The development roller is supplied with a bias voltage so as to enable it to recover toners present on the surface of the photoconductor by transferring these residual toners from the photoconductor to the development unit.

The bias power supply has a polarity which is reversed during an image non-forming time with respect to the polarity of the bias voltage applied to the above stated cleaning roller and the development roller during the printing operation.

Further, in the cleaner unit of the image forming apparatus, the re-charging of the toners by the cleaning roller and the reversal charge promoting member is carried out automatically by the above stated reversal charge promoting member.

In the image forming apparatus according to the present invention, since the bias voltage during the image formation has a reverse polarity with respect to the toners which have remained on the photoconductor after the transfer process and this bias voltage is applied to the cleaning roller, the residual toners on the photoconductor are recovered by an electrostatic force from the photoconductor.

A part of the toners recovered by the cleaning roller is charged to have a reverse polarity with respect to the polarity of the residual toners which have remained on the photoconductor by the reversal charge promoting member, which is arranged adjacent to or in contact with the cleaning roller of the cleaner unit.

When the toners are reversely charged, since the polarity of the toners has the same polarity as the bias polarity which is applied to the cleaning roller, the toners are transferred from the cleaning roller to the photoconductor according to the electrostatic force. In this case, the amount of the toners reversely charged in the cleaner unit has a predetermined value and this predetermined amount of the toners represents a smaller amount than the amount of the toners recovered by the cleaning roller.

The reversal charge promoting member is set so as not to affect the image which is formed in a next process according to the toners discharged on the photoconductor by the re-charge of the above stated toners. In other words, the reversal charge promoting member of the cleaner unit according to the present invention operates to reduce the toner discharge amount and control the speed of the reversal charging. Accordingly, the image is not disturbed due to the re-discharged toners.

Further, the toners which are re-discharged from the cleaner unit to the photoconductor are settled down to have the same polarity as that of the surface of the photoconductor as produced by the charger unit.

Next, in the development unit of the image forming apparatus, during the image forming operation, the bias has the same polarity as the surface potential of the photoconductor charged by the charger unit, and further has absolutely and substantially a zero potential near to the potential on the surface of the photoconductor.

Since the above stated bias is applied to the development roller, the toners which have acquired the same polarity as the charge on the surface of the photoconductor are recovered to the development roller of the developer unit.

Besides, during the image non-forming operation, the bias applied to the cleaning roller and the development roller is opposite to the polarity of the bias which is applied during the image formation and the charge polarity of the toners on the photoconductor has the same bias as the bias of the cleaning roller of the cleaner unit.

Further, since the above bias has a reverse polarity with respect to the bias applied to the development roller, the toners on the photoconductor are not recovered in the cleaner unit, but are recovered in the developer unit as they are.

Further, as to the toners which have remained in the cleaner unit, since the reverse charging of the toners is carried out automatically or stopped, the toners have the same polarity as the bias applied to the cleaning roller. After the toners are transferred by the electrostatic force from the cleaning roller to the photoconductor, the toners are recovered in the developer unit by the development roller.

Employing the image forming apparatus constituted as described above, the construction of the image forming apparatus can be simplified and the image forming apparatus can be constituted to have a compact size. At the same time, since the toners are finally recovered in the developer unit, it is possible to reuse the recovered toners, accordingly there is no waste of toners in the image forming apparatus.

Further, even when the printing operation is carried out by continuously feeding a printing sheet, since the toners are gradually discharged from the cleaner unit during the image forming operation at the same time, the lowering of the cleaning performance of the image forming apparatus will hardly occur even with an increase in the accumulated amount of toners on the cleaning roller. As a result, an image forming apparatus which is able to withstand a long period of practical use can be provided.

DESCRIPTION OF THE INVENTION

Hereinafter, one embodiment of an image forming apparatus according to the present invention will be explained with reference to FIG. 1 to FIG. 7.

Figure 1:
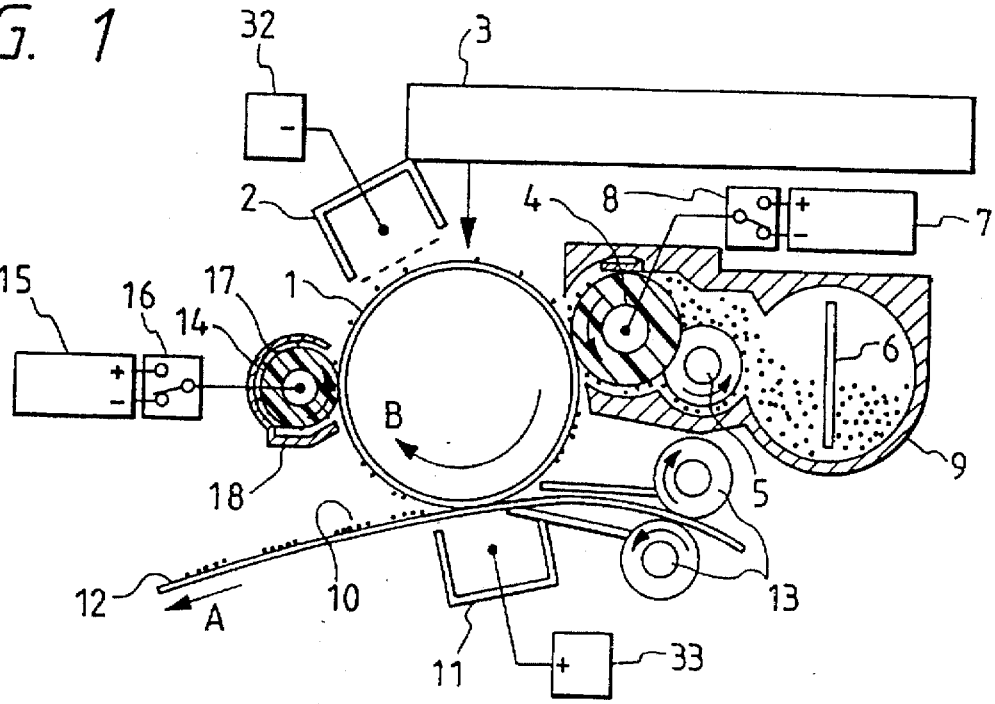
FIG. 1 is a schematic diagram showing one embodiment of an image forming apparatus according to the present invention.

FIG. 1 shows one embodiment of an image forming apparatus according to the present invention. The image forming apparatus comprises a photoconductor 1 serving as an image bearing body, a charger unit 2, an exposure unit 3, a developer unit 9 for supplying toners 10, a cleaner unit 17, a printing sheet 12 serving as a recording medium, a resist roller arrangement 13, and a transfer unit 11.

In the above stated image forming apparatus, the photoconductor 1 comprises an organic photoconductor having a negative charge. The developer unit 9 employs a reversal development system in which a part of the photoconductor surface irradiated by the light according to the exposure unit 3, is subjected to development and this developer unit 9 includes a development roller 4, a toner transfer roller 5 and a toner blending blade member 6.

A power supply 7, which operates to supply a bias potential having a positive polarity and a negative polarity, is connected to the development roller 4 through a polarity switching unit 8 for changing over the polarity. The development roller 4 receives a predetermined voltage, and during the printing operation, the development roller 4 has applied thereto the negative polarity of the power supply 7, while during a non-printing time, the development roller 4 has the positive polarity of the power supply 7 applied thereto.

Further, the charger unit 2 and the transfer unit 11 are constituted to generate an electric charge according to a corona discharge. A power supply 32 having a negative polarity, for supplying a negative charge to the photoconductor 1, is connected to the charger unit 2, while a power supply 33 having a positive polarity, for supplying a positive electric charge to the printing sheet 12, is connected to the transfer unit 11.

Further, the cleaner unit 17 comprises a cleaning roller 14 formed by a conductive rubber member and a toner reversal charge promoting member 18, which contacts a surface of the cleaning roller 14 and is formed by a semi-conductive member.

Further, a power supply 15 operates to apply a bias potential having a positive polarity and a negative polarity to the cleaning roller 14 through a polarity switching unit 16. During the printing operation and a non-printing time, the cleaning roller 14 is supplied with the negative polarity bias potential of the power supply 15.

Further, the reversal charge promoting member 18 has the same potential as the potential which is applied to the cleaning roller 14.

Hereinafter, the process of image formation carried out by the above embodiment of the image forming apparatus according to the present invention will be explained in detail.

First of all, image information is inputted from outside of the image forming apparatus through a communicating signal and is transmitted to an image information processing unit (not shown). In the image information processing unit, image information amounting to one page of the printing sheet is processed and timing information for exposing the photoconductor 1 is formed according to the exposure unit 3.

Next, at the time of formation of the timing information, a starting command for printing operation is issued from the image information processing unit to a controlling unit (not shown) of the image forming apparatus. In response to this command, the photoconductor 1 rotates in the direction of arrow B in the figure; and, at the same time, the power supplies 32, 7, 33 and 15, which are respectively connected to the charger unit 2, the development roller 4, the transfer unit 11 and the cleaning roller 14, perform according to the operating timings shown in FIG. 2.

Figure 2:
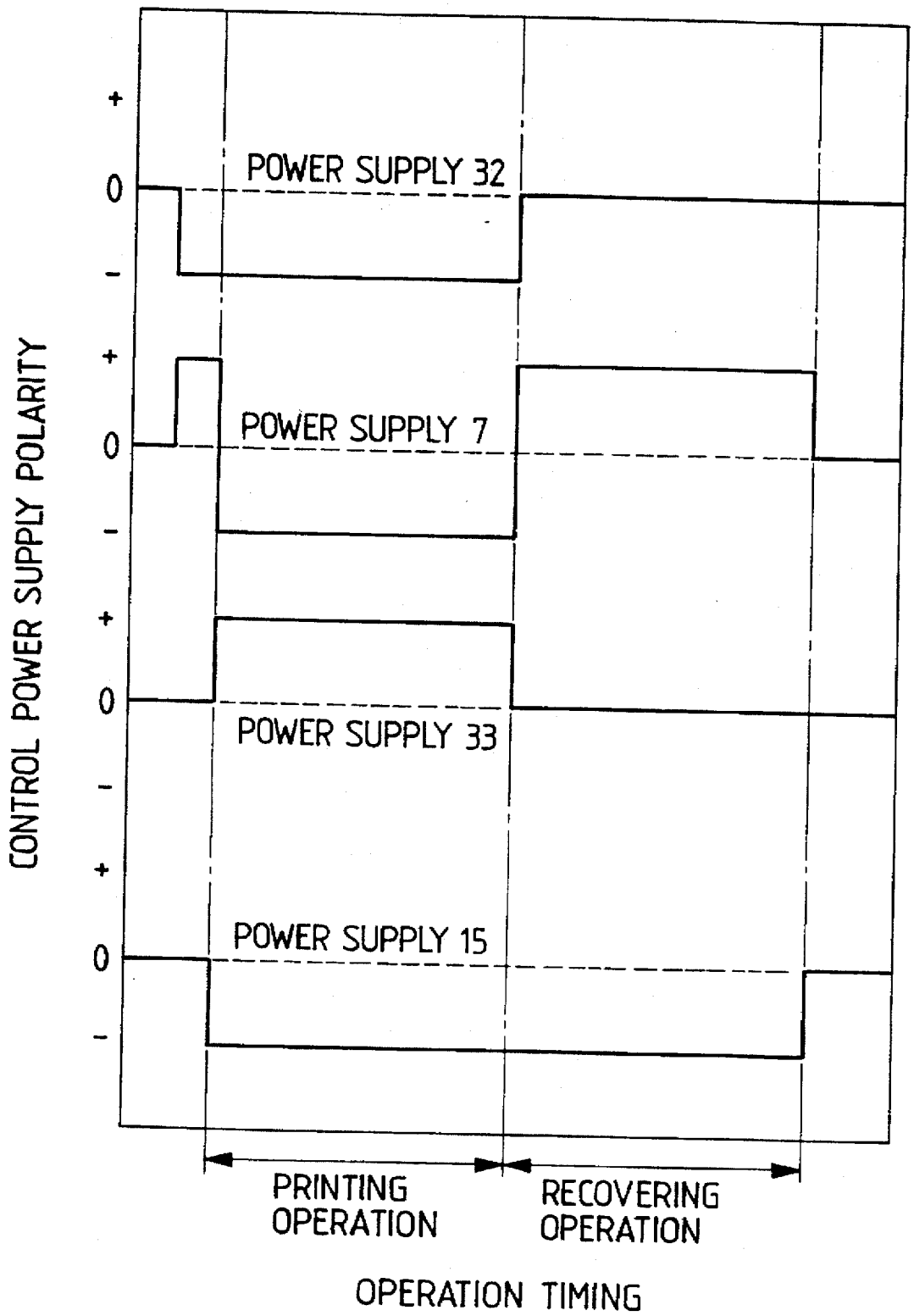
FIG. 2 is a timing diagram showing the timing of a main power supply controlling operation of an image forming apparatus according to the present invention.

At this time, the polarity switching units 8 and 16, which are respectively connected to the development roller 4 and the cleaning roller 14, operate to apply a bias potential having the polarity shown in FIG. 2 to the development roller 4 and the cleaning roller 14.

As shown in FIG. 2, when the power supply 32 connected to the charger unit 2 is turned "on", a negative charge is supplied from the charger unit 2 shown in FIG. 1 to the photoconductor 1, and then the photoconductor 1 is charged to about −600 V at the surface potential. At this time, a bias potential having a positive polarity is applied to the development roller 4. This is so that the toners 10 will be prevented from transferring from the development roller 4 to the photoconductor 1 regardless of the existence of the charge on the photoconductor 1 produced by the charger unit 2.

In company with the operation in the charger unit 2 shown in FIG. 2, next, from the controlling unit (not shown) of the image forming apparatus, a signal is transmitted to a supply unit for supplying the printing sheet 12, a tip of the printing sheet 12 is transported to the resist roller arrangement 13 and the printing sheet 12 then waits for the next process at this position.

At the time when the printing sheet 12 reaches the resist roller arrangement 13, the bias potential applied to the development roller 4 changes over to the negative polarity and, at the same time, the power supply 33 connected to the transfer unit 11 is turned "on", so that a bias potential having a positive polarity is applied to the cleaning roller 14.

Further, from the image information processing unit, the timing information for the exposure is transmitted to the exposure unit 3, and then the exposure of the photoconductor 1 starts in accordance with this timing information.

At this time, the toners 10 on the development roller 4 are charged at −10 to −20 μC/g degree by tribo-electricity, and the potential is added to the development roller 4. The above potential represents an intermediate potential between the potential of a background portion formed by the charging operation of the above stated photoconductor 1 and the potential of an electrostatic latent image portion formed by the above stated exposing operation. Accordingly, the toners 10 are adsorbed only in the areas of the electrostatic latent image, and a visual image is formed on the photoconductor 1 by the toners 10.

In accordance with the transfer timing, the printing sheet 12 waiting at the entry position of the resist roller arrangement 13 is advanced accordance with the rotation of the resist rollers 13; and, at the operating position of the transfer unit 11, the image formed by the toners 10 is transferred from the photoconductor 1.

The printing sheet 12 carrying the transferred image is advanced in the direction of arrow A in the figure, toward a fuser unit (not shown). After the non-fused toner image on the printing sheet 12 is fixed, the printing sheet 12 is discharged from the apparatus, and then the printing is finished.

Further, after the transfer process, the toners 10 which have remained on the surface of the photoconductor 1 are cleaned by the cleaner unit 17, the photoconductor 1 moves to the charging process, and a next image preparation is carried out.

Herein, the operations of the transfer unit 11 and the cleaner unit 17 of the above embodiment of the image forming apparatus will be explained mainly with reference to FIG. 3.

Figure 3:
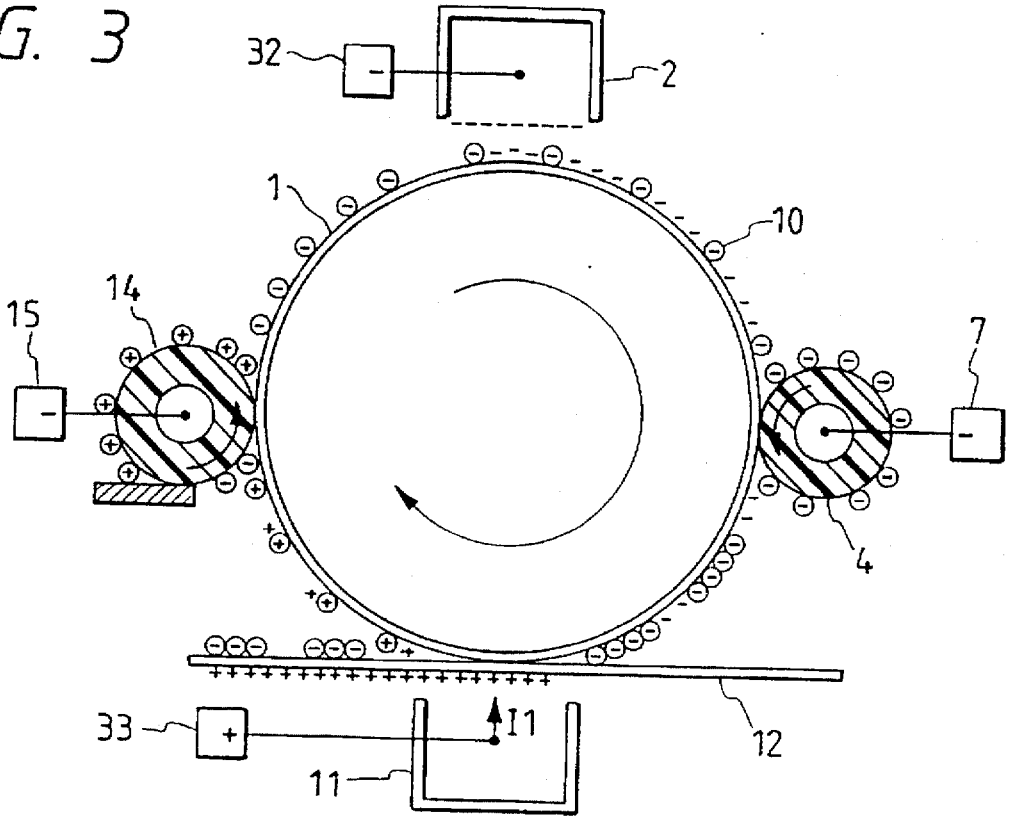
FIG. 3 is a schematic diagram showing a toner recovering and discharging operation of an image forming apparatus according to the present invention.

As shown in FIG. 3, the transfer unit 11 of the image forming apparatus according to the present invention is connected to the power supply 33, which provides a positive polarity so as to produce a corona discharge. The positive electric charge generated by the corona discharge is supplied to the printing sheet 12 as a current I1, and by the operation of the electrostatic force the toners 10 are attracted from the surface of the photoconductor 1 and transferred to the printing sheet 12.

Figure 4:
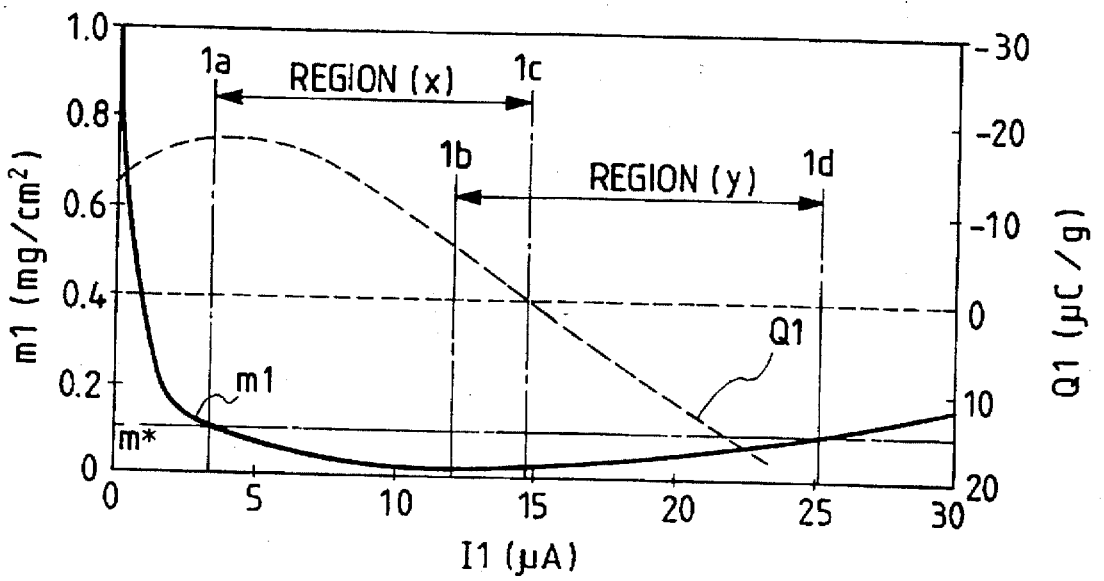
FIG. 4 is a diagram showing a transfer characteristic of a transfer unit of an image forming apparatus according to the present invention.

Herein, the relationship between the current I1 supplied to the printing sheet 12 and the weight m1 of the toners 10 which have remained on the photoconductor 1 after the transfer will be shown with reference to FIG. 4. Further, FIG. 4 shows simultaneously the relationship between the printing sheet supply current I1 and the charge amount Q1 of the remaining toners 10 after the transfer.

As shown in FIG. 4, the remaining toner amount Q1 after the transfer abruptly decreases in company with an increase in the printing sheet supply current I1. After the printing sheet supply current I1 becomes a minimum, the current value which is equal to the current 1*b* and the printing sheet supply current I1 gradually increases.

Further, after the charge amount Q1 of the residual toners 10 increases a little at the initial period in company with an increase in the printing sheet supply current I1, the charge amount Q1 of the residual toners 10 monotonously decreases. When the printing sheet supply current I1 reaches a current value which is equal to the current 1*c*, the polarity of Q1 is reversed from the negative polarity to the positive polarity.

Herein, in this image forming apparatus, the upper limit of the toners 10 which may remain on the photoconductor 1 after the transfer is provided at 1/10 (this amount is shown as m* in figure) of the toners which existed on the photoconductor 1 before the transfer. So as to satisfy the above stated requirement, it is necessary to set the printing sheet supply current I1 within a range from the current 1*a* to the current 1*d*.

However, the cleaning roller 14 of the cleaner unit 17 is supplied with a negative polarity bias, as shown in FIG. 2, during the printing operation. Thereby, so as to effecting removal of the toners 10 which cling to the photoconductor 1 by electrostatic force, it is necessary for the toners 10 to have a positive polarity.

In the image forming apparatus, the printing sheet supply current I1 is set in a region (y) which extends from the current 1*b* to the current 1*d*. Accordingly, the charge amount Q1 of the residual toners 10 after the transfer has a positive polarity, and also the charge amount of the residual toners 10 is less than the toner amount of m*, so that the residual toner amount represents a very small amount.

Next, in the cleaner unit 17 of the above embodiment of the image forming apparatus, as shown in FIG. 2, during the printing operation, since a negative polarity bias is applied to the cleaning roller 14, the positive polarity toners 10 present on the photoconductor 1 are absorbed by the electrostatic force and cleaning is carried out on the surface of the photoconductor 1, but some amount of negative charged toners 10 are left on the photoconductor 1 as they are.

As to the toners 10 which have adhered to the cleaning roller 14, in this adhesion condition, the charge amount is reversed from the positive polarity to the negative polarity, and this principle will be explained in detail hereinafter.

As a method for charging the toners 10 which have adhered to the cleaning roller 14 to the negative polarity, in this image forming apparatus according to the present invention, tribo-electric charging between the adhered toners 10 on the cleaning roller 14 and the reversal charge promoting member 18 is utilized.

Figure 5:
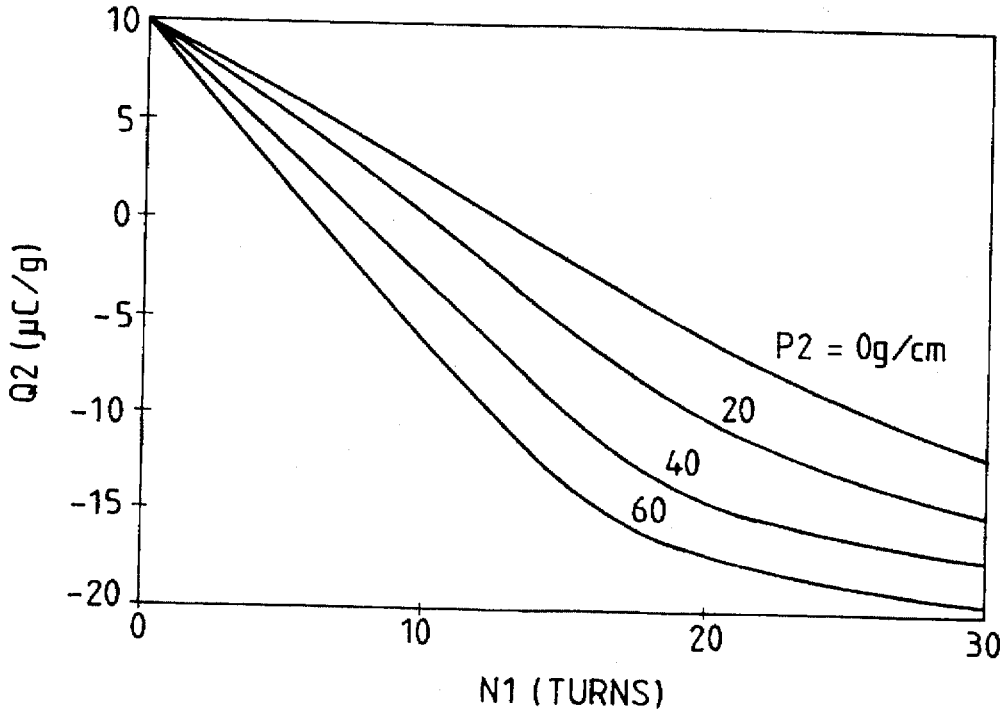
FIG. 5 is a diagram showing a reversal characteristic of the toners of a cleaner unit of an image forming apparatus according to the present invention.

FIG. 5 shows the reversal charge characteristic of the toners 10 of the cleaner unit 17 of the image forming apparatus according to the present invention.

FIG. 5 is a view showing the change in the toner charge amount Q2 in accordance with the turns (numbers) N1 of the cleaning roller 14 in contact with the reversal charge promoting member 18. Namely, the charge amount Q1 (10 μC/g) which has adhered to the cleaning roller 14 changes to the toner charge amount Q2, which is tribo-electrically charged by the reversal charge promoting member 18. This reversal charge promoting member 18 is mounted so as to push with a pressure P2 against the cleaning roller 14.

According to FIG. 5, the toner charge amount Q2 increases toward the negative polarity in company with an increase in the number of contacting turns N1 and tends to saturate at the charge amount of substantially negative 20 μC/g. This value is the saturation charge amount obtained by adding a charge control agent etc. to the toners 10.

In FIG. 5, in company with an increase in the pressure P2, the increasing tendency toward the negative side of the charge amount Q2 becomes even larger. Accordingly, by adjusting the pressure P2, it is possible to limit the discharge amount of the toners 10 transferred from the cleaning roller 14 to the photoconductor 1, or it is possible to control the speed of the discharge amount of the toners 10.

Further, an increase in the pressure P2 for pushing the reversal charge promoting member 18 against the cleaning roller 14 is related to an increase in abrasion of the cleaning roller 14 and the reversal charge promoting member 18.

Besides, in addition to the reversal charging, on the reversal charge promoting member 18, the effect for uniformly dispersing the toners 10 which have adhered to the cleaning roller 14 can be increased by an increase in the pushing pressure P2. Accordingly, when higher abrasion of the above stated members is permitted, it is desirable to further increase the pressure P2.

In the image forming apparatus according to the present invention, from the standpoint of reducing the manufacturing cost of the image forming apparatus and of providing a long life for the constituting members, the minimum pressure P2 (0 g/cm or under the contacting condition) is used, and under this pressure P2 the effect of uniformly dispersing the toners 10 present on the cleaning roller 14 can be fully obtained.

When the above stated pressure P2 of 0 g/cm is used, from the results shown in FIG. 5 and when the charge amount Q2 of the toners 10 immediately after transfer to the cleaning roller 14 is 10 μC/g, by causing the toners 10 to contact the reversal charge promoting member 18 about 10 (ten) times, the charge polarity of the toners 10 is reversed. Thus, the reversely charged toners 10 can be re-discharged on the photoconductor 1 during a rotation operation of more than ten times.

At this time, the above stated charge amount Q2 of the toners 10 is a mean (average) charge amount of the toners 10 which have adhered to the cleaning roller 14 and from the point of view of the charge amount distribution, a deviation range of 0–10 μC/g exists.

As a result, the toners 10 having a charge amount Q2 of less than 10 μC/g are discharged of less than 10 rotations of the cleaning roller 14, however the toners 10 having a charge amount Q2 of more than 10 μC/g require more than 10 rotations for discharge.

As stated above, since the toners having a charge amount of less than 10 μC/g are discharged in less than 10 rotations, the toners 10 recovered in the cleaning roller 14 are dispersed and discharged as time elapses, and the influences on the charger process and the exposure process following the cleaner unit 17 can be lessened.

Further, even if the charge amount of the toners 10 stabilizes at 10 μC/g, by the uniforming effect produced by the reversal charge promoting member 18, the toners 10 which have adhered to the cleaning roller 14 are dispersed, and therefore the effects on the charger process and the exposure process following the cleaner unit 17 can be lessened.

Herein, the problem which has previously occurred in the charger process and the exposure process relates to a case in which the toners 10 continuously adhere to and cover the photoconductor 1. However, in the image forming apparatus according to the present invention, the toners 10 are dispersedly discharged in the cleaner unit 17, at the time of passing through to the charger unit 2, since the rounding of the electric charging occurs on the face of the photoconductor 1 shielded by the toners according to the corona discharge, and so the problem does not arise.

Further, in the exposure process, ordinarily, since the spot diameter of the light is about 4–8 times the toner diameter, in the image forming apparatus in which the toners 10 do not continuously adhere to the photoconductor 1, the problem does not arise.

As stated above, during the printing operation, the toners 10 are re-discharged on the photoconductor 1 from the cleaner unit 17, and even if the charge polarity of the toners 10 is positive, the cleaning effect produced by the cleaning roller 14 is not 100%. However, there is a case in which a very small amount of the toners 10 will be passed through the cleaner unit 17 with a positive polarity.

Figure 6:
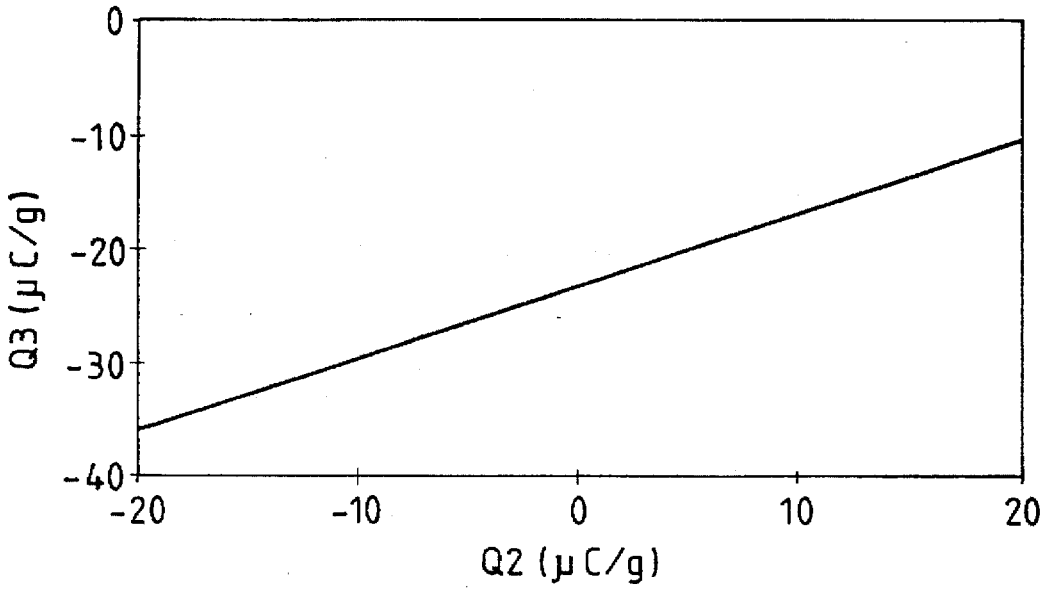
FIG. 6 is a diagram showing a charge characteristic of the toners of a charger unit of an image forming apparatus according to the present invention.

The above-described toners 10 having a positive polarity are given a negative charge by the charger unit 2. FIG. 6 shows a relationship between the toner charge amount Q2 before the toners enter the charger unit 2 and the toner charge amount Q3 after they pass-through the charger unit 2. The toner charge amount before they enter the charger unit 2 is 20 μC/g and the toners 10 change thereafter to have a negative polarity.

Further, in the exposure process, the charge amount of the toners 10 does not change. Accordingly, in passing through the charger process and the exposure process, almost all toners 10 reaching the development roller 4 are negatively charged.

The principle for recovering the toners 10 reaching the development roller 4 according to the above stated process in the development roller 4 will be explained hereinafter.

The developer unit 9 used in the image forming apparatus according to the present invention employs a contact type non-magnetic one component toner development system. In this development system, the toners 10 having a negative electric charge are directly sandwiched between the surface of the photoconductor 1 and the surface of the development roller 4 without the existence of the magnetic powders.

Herein, whether the sandwiched toners 10 are attracted toward the face of the photoconductor 1 or toward the face of the development roller 4 depends on the direction of the electrostatic force acting on the toners 10. The amount and the direction of the electrostatic force are determined in accordance with the potential difference ΔV0, and the above stated potential difference ΔV0 is represented by the difference between the surface potential VP of the photoconductor 1 and the potential VR applied to the development roller 4.

Figure 7:
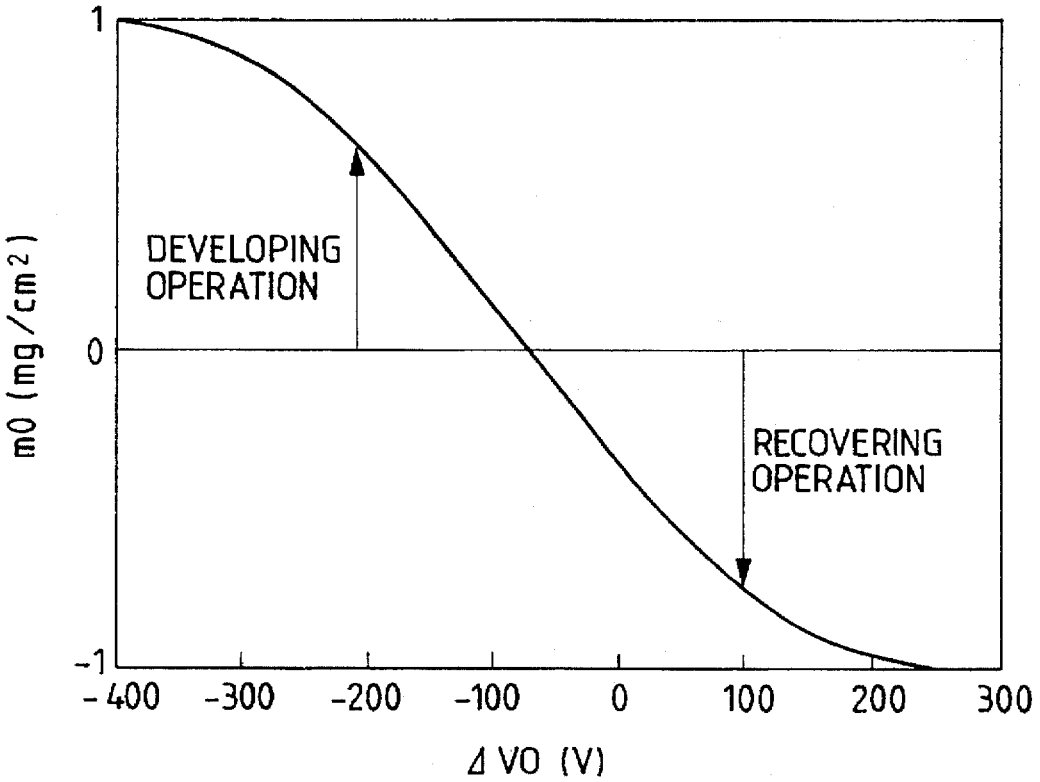
FIG. 7 is a diagram showing a development and a toner recovery characteristic of a developer unit of an image forming apparatus according to the present invention.

FIG. 7 shows a relationship between the potential difference ΔV0 and the amount m0 of the toners 10 which S are attracted to the face of the photoconductor 1. When the potential difference ΔV0 become larger than about −100 V toward the negative side, the toners 10 are attracted toward the face of the photoconductor 1 and the process acts as a developing operation. When the potential difference ΔV0 becomes larger than about −100 V toward the positive side, the toners 10 are attracted toward the face of the development roller 14 and the process acts as a recovery operation.

In the image forming apparatus according the present invention, during printing, the potential VR applied to the development roller 4 is −300 V degree, while the surface potential VP of the photoconductor 1 is −600 V degree at the non-exposure portion and is −80 V degree at the exposure portion. As a result, the potential difference ΔV0 is −600 V degree at the non-exposure portion and is −220 V degree at the exposure portion.

As stated above, in the image forming apparatus according to the present invention, the developing operation at the exposure portion and the recovering operation at the non-exposure portion are carried out at the same time, and so the toners 10 discharged to the photoconductor 1 according to the above stated cleaner unit 17 are recovered in the interior portion of the developer unit 9 in parallel with the development process.

In this process, the toners 10 at the exposure portion are not recovered in the developer unit 9; however since the exposure portion is a portion in which the image according to the toners 10 is formed, and since the non-recovered toners 10 are transferred to the printing sheet 12 at the next transfer process in company with the newly developed toners 10, a problem does not occur.

The above stated process acts in an opposite manner in case of toners having a positive polarity, namely the recovering operation is carried out at the exposure portion of the photoconductor 1 and the development process is carried out at the non-exposure portion of the photoconductor 1. In this case, at the transfer process, the toners 10 having the positive polarity are not transferred to the printing sheet 12, but pass through the cleaner unit 17 again and eventually reach the developer unit 9.

However, in the ordinary printing operation, the non-exposure portion is 90%, but the exposure portion is 10%, thereby the non-exposure portion is overwhelmingly larger than the exposure portion. When the toners 10 are charged to a positive polarity, since the toner recovery to the developer unit 9 is slow, it is desirable for the toners 10 destined for the developer unit 9 to have a negative polarity.

In the image forming apparatus of the above-described embodiment according to the present invention, by the provisions of the cleaner unit 17 and the charger unit 2, since the toners 10 necessarily come to have a negative polarity, the toner recovery to the developer unit 9 can be speedily carried out.

As stated above, during the printing operation after the toners 10 recovered by the cleaner unit 17 are successively re-discharged to the photoconductor 1 and the recovered toners 10 are recovered in the developer unit 9, the accumulation of the toners 10 on the cleaning roller 14 is very small, thereby a lowering of the cleaning performance of the image forming apparatus due to the long period of continuous use is reduced.

However, in the image forming apparatus according to the present invention, so as to further reduce the lowering of the cleaning performance of the image forming apparatus, after the printing operation, the recovery time for increasing the recovery performance of the toners 10 to the developer unit 9 is provided.

Next, the operation of the image forming apparatus at the recovery time will be explained.

In the image forming apparatus shown in FIG. 2, at the time of completion the printing operation, the power supplies 32 and 33, respectively connected to the charger unit 2 and the transfer unit 11, are turned "on" and at the same time the polarity switching unit 8 connected to the development roller 4 is operated, thereby the bias potential applied to the development roller 4 is changed over to the positive polarity.

In the image forming apparatus according to the present invention, in the above case, a voltage of 300 V is applied. Further, in this case, the potential applied to the cleaning roller 14 is left at the negative polarity. Further, as not shown, between the interval from the time immediately after the bias polarity applied to the development roller 14 is changed over to the positive polarity to the end of one rotation of the photoconductor 1, the whole surface of the photoconductor 1 is subjected to exposure by the exposure unit 3 and the surface potential of the photoconductor 1 reaches the vicinity of the potential of 0 V.

In accordance with the above stated series of operations, after the toners 10 in the cleaner unit 17 become negative in the polarity and are transferred to the photoconductor 1, the toners 10 reach the developer unit 9. Herein, over the whole region formed on the development roller 4 and the photoconductor 1, the potential difference $\Delta V0$ is 300 V, the recovery performance of the toners 10 from the photoconductor 1 increases. Also, since the whole region of the photoconductor 1 is employed for the recovery operation of the toners 10, the recovery efficiency of the toners 10 will increase in comparison with the printing time.

Further, in the initial period of the recovery operation of the toners 10, since the toners 10 which have adhered to the development roller 4 are not sufficiently charged, some toners 10 which are positively charged will be present, thereby the positively charged toners 10 are discharged from the development roller 4 to the photoconductor 1. However, after the positively charged toners 10 are recovered once in the cleaner unit 17, the toners 10 are negatively charged and discharged, thereby a problem is not produced.

The toners 10 which have adhered to the development roller 4 are sufficiently charged, so that from the time during which the positively charged toners 10 are not longer discharged, the passage along which the toners 10 move only extending from the cleaner unit 17 to the developer unit 9. Accordingly, the amount of the toners 10 in the cleaner unit 17 decreases with the lapse of time, and after the lapse of a predetermined time almost all toners 10 are recovered in the inner portion of the developer unit 9.

By using the image forming apparatus described above according to the present invention, the image forming apparatus is simplified and an image forming apparatus of compact size can be manufactured. At the same time the toners 10 are finally recovered in the developer unit 9 and it is possible to reuse the toners. As a result, a waste of toners does not occur.

Further, even when the printing operation is carried out by continuously feeding a printing sheet 12, at the same time as the image forming operation, the toners 10 are gradually discharged from the cleaner unit 17, and a lowering of the cleaning performance of the image forming apparatus hardly occurs even with an increase in the amount of toner accumulated on the cleaning roller 14. Thereby, the image forming apparatus is able to withstand a long period of practical use.

Hereinafter, another embodiment of the image forming apparatus according to the present invention will be explained with reference to FIG. 8 to FIG. 11, in addition to FIG. 4 and FIG. 6.

Figure 8:
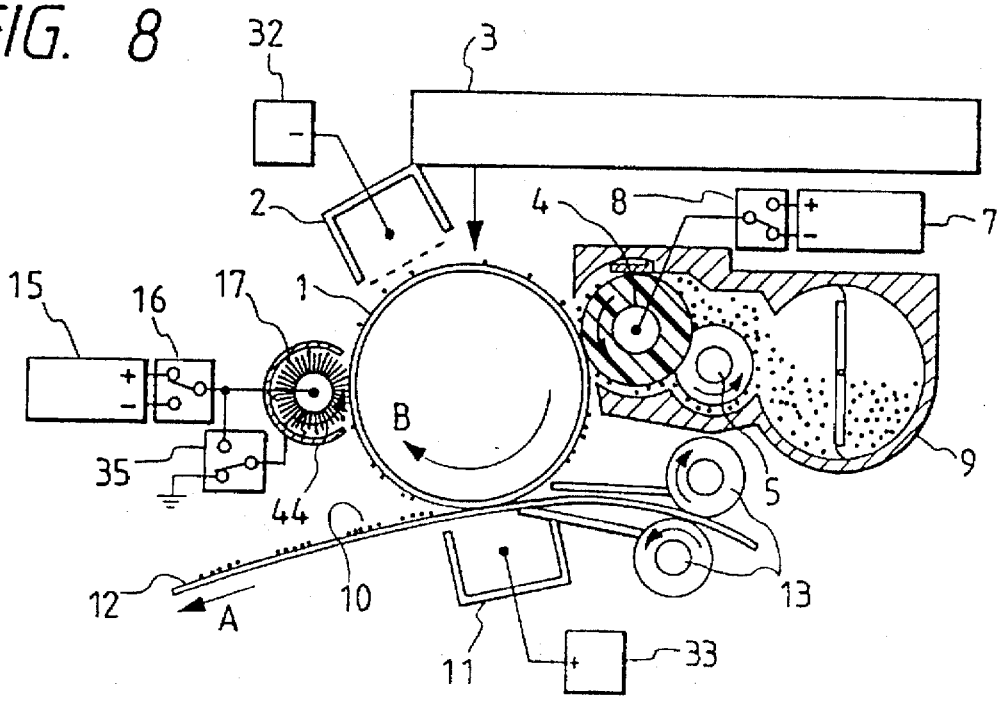
FIG. 8 is a schematic diagram showing another image forming apparatus according to the present invention.

FIG. 8 shows a schematic view of another embodiment of the image forming apparatus according to the present invention. The construction shown in FIG. 8 is the same construction shown in FIG. 1, except for the cleaner unit 17. The cleaner unit 17 in this embodiment uses a cleaning brush 44 on which conducting members are installed, in place of the cleaning roller 14 shown in FIG. 1.

In the surrounding portion of the cleaning brush 44, a reversal charge promoting member 18 for the toners 10 is provided. This reversal charge promoting member 18 contacts a surface of the cleaning brush 44 and is constituted by a conducting member conforming to the outer shape of the cleaning brush 44. Besides, the power supply 15, designed to apply a positive polarity and a negative polarity bias potential, is connected to the cleaning brush 44 a polarity switching unit 16 for changing over the polarity.

In the printing operation, a predetermined voltage having a positive polarity is applied to the cleaning brush 44 by the power supply 15, while during a non-printing time, a predetermined voltage having a negative polarity is applied to the cleaning brush 44 by the power supply 15.

Further, the reversal charge promoting member 18 normally is at ground potential, but a potential having the same bias potential as the cleaning brush 44 is also applied thereto through the bias potential switching unit 35.

Hereinafter, the image formation process in this embodiment of the image forming apparatus according to the present invention will be explained in detail.

In this image forming apparatus, first of all, image information is inputted in the form of a communication signal from outside of the image forming apparatus and is transmitted to an image information processing unit (not shown). In the image information processing unit, the image information amounting one page of the printing sheet 12 is processed, and the exposure unit 3 operates to generate timing information to control exposure of the photoconductor 1.

Next, at the time of the generation of the timing information, a starting of the printing operation is commanded from the image information processing unit to a control unit (not shown) of the image forming apparatus. In response to this command, the photoconductor 1 rotates in the direction of arrow B in the figure, and at the same time, the power supplies 32, 7, 33 and 15, respectively connected to the charger unit 2, developing roller 4, the transfer unit 11 and the cleaning brush 44 present, are turned "on" in accordance with the timings shown in FIG. 9.

Figure 9:
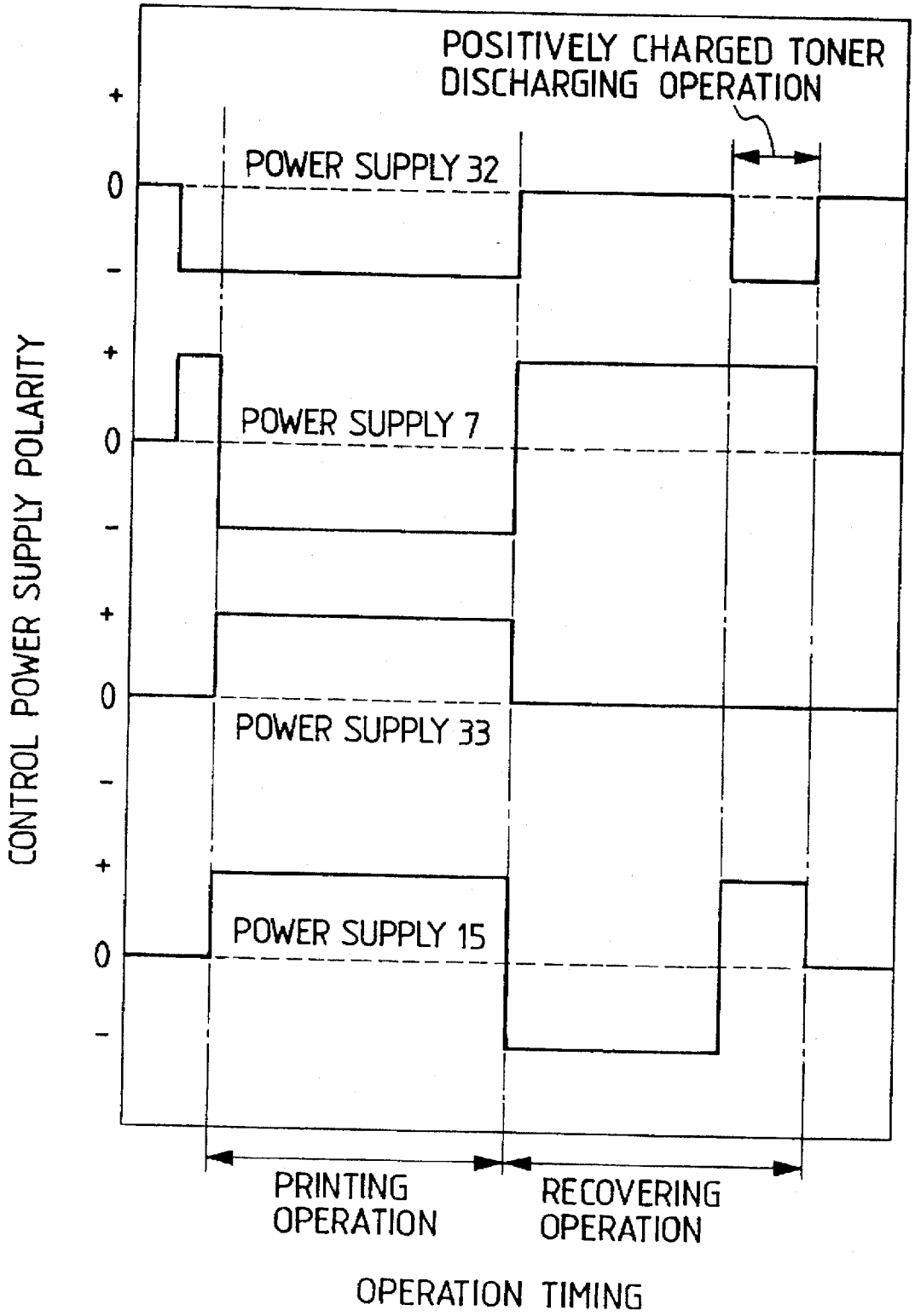
FIG. 9 is a timing diagram showing the timing of a main power supply controlling operation of an image forming apparatus according to the present invention.

At this time, the polarity switching units 8 and 16, respectively connected to the development roller 4 and the cleaning brush 44, operate so that the bias potential at the polarity shown in FIG. 9 is applied to the development roller 4 and the cleaning brush 44.

As shown in FIG. 9, when the power supply 32 connected to the charger unit 2 is "on", a negative electric charge is supplied to the photoconductor 1 from the charger unit 2 shown in FIG. 8 and the photoconductor 1 is charged to about −600 V as the surface potential.

At this time, a bias potential having a positive polarity is applied to the development roller 4. This results in the toner adhesion from the development roller 4 to the photoconductor 1 being prevented regardless of the existence of the charge on the photoconductor 1 produced by the charger unit 2.

In company with the operation of the charger unit 2 shown in FIG. 8, from the control unit (not shown) of the image forming apparatus a signal is transmitted to a unit (not shown) for applying the printing sheet 12. The tip end of the printing sheet 12 is transferred to the entry of the resist roller arrangement 13, and at this position, the printing sheet 12 waits for the next process.

At the time the printing sheet 12 reaches the resist roller arrangement 13, the bias potential applied to the development roller 4 changes over to the negative polarity, and at the same time, the power supply 33 connected to the transfer unit 11 turns "on", so that a bias potential having a positive polarity is applied to the cleaning brush 44.

Further, from the image information processing unit, the timing information for effecting exposure is transmitted to the exposure unit 3, and the exposure of the photoconductor 1 starts in response to the timing information. At this time, the toners 10 present on the development roller 4 are charged to −10—20 μC/g degree from the tribo-electricity, and a potential, which corresponds to an intermediate potential between the potential of the background portion of the photoconductor 1 formed by the charger and the potential of the electrostatic latent image portion formed by the above stated exposure, is applied to the development roller 4. As a result, the toners 10 are absorbed only at the position of the electrostatic latent image, and a visual image produced by the toners 10 is formed on the photoconductor 1.

Besides, at the transfer timing, the printing sheet 12 waiting at the resist roller arrangement 13 is conveyed forward by the rotation of the resist roller arrangement 13, and at the operative position of the transfer unit 11 the image formed by the toners 10 is transferred from the photoconductor 1. The printing sheet 12 carrying the transferred image is carried further in the direction of arrow A in the figure and sent to the fuser unit (not shown). After the non-fused toner image on the printing sheet 12 is fixed, the printing sheet 12 is discharged from the image forming apparatus, and the printing is finished.

Further, after the transfer process on the photoconductor 1 is completed, and any toners 10 which remain on the surface of the photoconductor 1 are cleaned by the cleaner unit 17, the processing moves to the charger process, and the next image formation is performed.

Herein, the operations in the transfer unit 11 and the cleaner unit 17 of the embodiment according to the present invention will be explained with reference mainly to FIG. 10.

Figure 10:
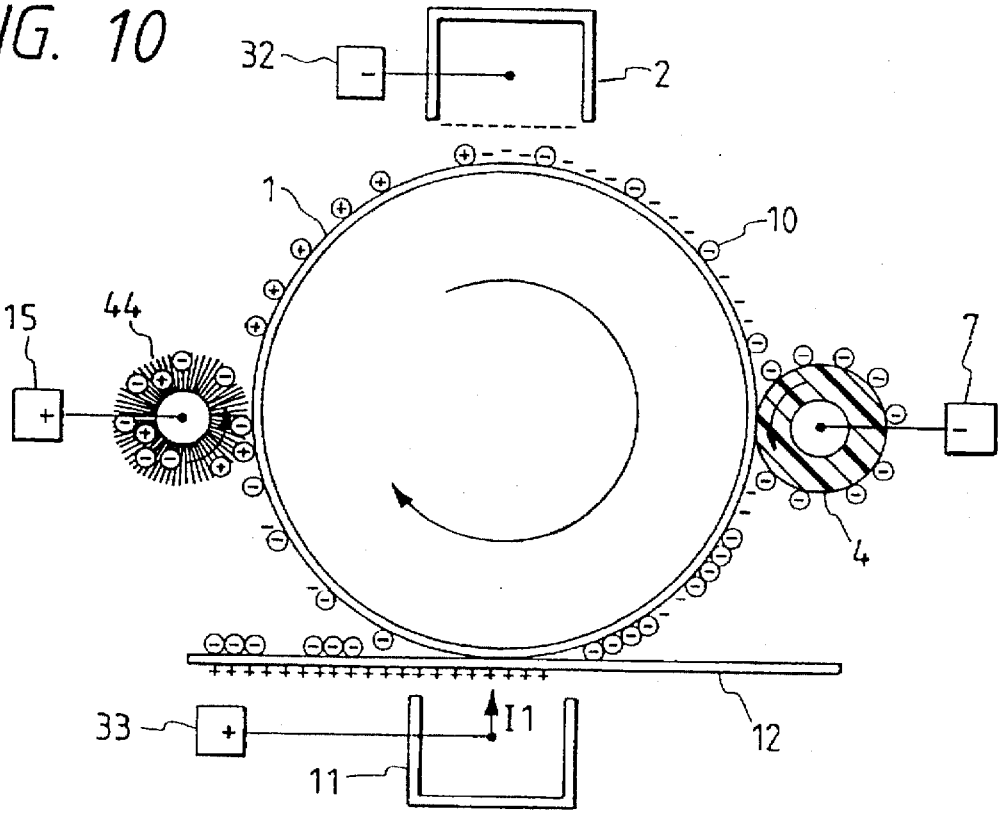
FIG. 10 is a schematic diagram showing a toner recovering and discharging operation of an image forming apparatus according to the present invention.

As shown in FIG. 10, in the image forming apparatus according to the present invention, the power supply 33 providing a bias potential having a positive polarity is connected to the transfer unit 11 and this power supply 33 generates a corona discharge. The positive electric charge generated by the above stated corona discharge is supplied to the printing sheet 12 as the current I1. In accordance with the action of the electrostatic force, the toners 10 are attracted from the surface of the photoconductor 1 and are transferred to the printing sheet 12 is carried out.

Now, the current I1 supplied to the above stated printing sheet 12 and the weight amount m1 of the toners 10 which remain on the photoconductor 1 after the transfer have a relationship as shown in FIG. 4. Further, in FIG. 4, the relation between the printing sheet supply current I1 and the charge amount Q1 of the residual toners 10 after the transfer is simultaneously.

As shown in FIG. 4, the residual toner amount m1, after the transfer, abruptly decreases in company with an increase of the printing sheet supply current I1, and after the current I1 is a minimum at the current value which is equal to the current 1*b*, the residual toner amount m1 has a tendency to gradually increase. Further, the residual toner charge amount Q1 increases a little at the initial period in company with an increase of the printing sheet supply current I1, after which the residual toner charge amount Q1 of the residual toners monotonously decreases. When the printing sheet supply current I1 reaches a current value which is equal to the current 1*c*, the polarity is reversed from the negative polarity to the positive polarity.

Herein, in this image forming apparatus, the upper limit of the toners 10 which are allowed to remain on the photoconductor 1 after the transfer represents 1/10 (this amount is shown as m* in figure) of the toner amount which existed on the photoconductor 1 before the transfer. So as to satisfy the above stated requirement, it is necessary to use the printing sheet supply current I1 within a range from the current 1*a* to the current 1*d*.

However, the cleaning brush 44 in the cleaner unit 17 is at a positive polarity, as shown in FIG. 9, during the printing operation. Thereby, in order to effect a removal of the toners 10 which are on the photoconductor 1 by an electrostatic force, it is necessary to have the toners 10 at a negative polarity.

In the image forming apparatus, the printing sheet supply current I1 that is used lies in a region (x) which extends from the current 1*a* to the current 1*c*. Accordingly, the charge amount of the residual toners 10 after the transfer has a positive polarity, and even the charge amount of the residual toners 10 is less than the toner amount of m*, so that the toner residual amount represents a very small amount.

Next, in the cleaner unit 17, as shown in FIG. 9, during the printing operation, since a negative polarity bias is applied to the cleaning brush 44, the negative polarity toners 10 present on the photoconductor 1 are attracted to the cleaning brush 44 by an electrostatic force and are cleaned from the photoconductor 1.

Now, for the toners 10 which have adhered to the cleaning brush 44, in the adhered state, the charge is reversed from the negative polarity to the positive polarity, and the principle of this phenomenon will be explained hereafter in detail.

As a method for charging the toners 10 which have adhered to the cleaning brush 44 to the positive polarity, in the image forming apparatus according to the present invention, the electric charge injection according to the current flowing between the cleaning brush 44 and the reversal charge promoting member 18 is employed.

Figure 11:
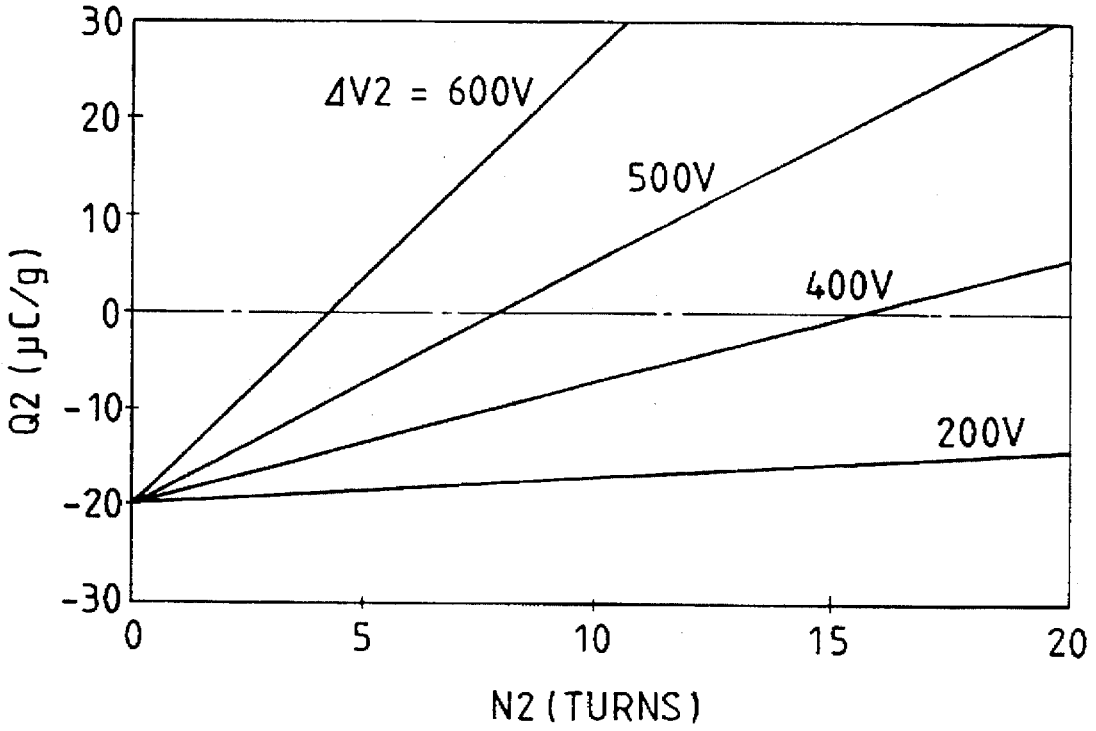
FIG. 11 is a diagram showing a reversal charge characteristic of the toners of a cleaning apparatus of an image forming apparatus according to the present invention.

FIG. 11 shows when the toners 10 which have adhered to the cleaning brush 44 and having the charge amount Q1 (−20 μC/g) are applied using a predetermined amount of the potential difference ΔV2 between the cleaning brush 44 and the reversal charge promoting member 18, the change of the toner charge amount Q2 after the injection of the electric charge to the toners 10 being indicated by the rotation turns (numbers) N2 of the cleaning brush 44.

According to FIG. 11, the charge amount Q2 of the toners 10 has a tendency to increase toward the side of the positive polarity in company with an increase of the potential difference ΔV2. Further, as seen in FIG. 11, in company with an increase in the potential difference ΔV2, the tendency of the charge amount Q2 to increase toward the side of the positive polarity is made even greater. As a result, when the potential difference ΔV2 is adjusted, the discharge amount and the discharge speed of the toners 10 transferred from the cleaning brush 44 to the photoconductor 1 can be limited.

In the image forming apparatus according to the present invention, the image forming apparatus is set such that, when the above stated potential difference ΔV2 is 500 V, judging from the result shown in FIG. 11, when the charge amount Q2 of the toners 10 immediately after capture by the cleaning brush 44 is −20 μC/g, the charge polarity of the toners 10 is reversed with about 10 rotation turns N2 of the cleaning brush 44, and at more than 10 rotations of the cleaning brush 44 the reversely charged toners 10 are re-discharged.

At this time, the charge amount Q2 of the toners shown in the above is a mean charge amount of the toners 10 which have adhered to the cleaning brush 44, and as viewed from the charge amount distribution, the toners 10 having exhibit a charge amount having a deviation range of 0–20 μC/g.

As a result, toners 10 having less than the absolute value of −20 μC/g of the charge amount Q2 are discharged in less than 10 rotations and toners 10 having more than the absolute value of −20 μC/g of the charge amount Q2 are discharged in more than 10 rotations.

Accordingly, since the toners 10 recovered in the cleaning brush 44 are dispersedly discharged as time passes, any undue influence on the charger process and the exposure process downstream of the cleaner unit 17 can be lessened.

Herein, the problem which has occurred in the charger process and the exposure process resides in a case in which the toners 10 continuously adhere to and cover the photoconductor 1. However, in the image forming apparatus according to the present invention, the toners are dispersedly discharged in the cleaner unit 17, at the time of passing through to the charger unit 2, since the rounding of the electric charge occurs at the face of the photoconductor 1 shielded by the toners 10 according to the corona discharge, and so the problem is not generated.

Further, in the exposure process, ordinarily, since the spot diameter of the light is about 4–8 times that of the toner diameter, and further, in the image forming apparatus, the toners 10 do not continuously adhere to the photoconductor 1, the problem is not generated.

As stated above, during the printing operation, the toners 10 are re-discharged on the photoconductor 1 as positive polarity toners 10 from the cleaner unit 17, thereby these positive polarity toners 10 are given a negative electric charge by the charger unit 2.

FIG. 6 shows the relationship between the toner charge amount Q2 before the entry into the charger unit 2 and the toner charge amount Q3 after to toner has passed through the charger unit 2. Even when the toner charge amount before the entry to the charger unit 2 is 20 μC/g, after it passes through, it changes to a negative polarity. Further, in the exposure process the charge amount of the toners 10 does not change.

Accordingly, almost all toners 10 which have passed through the charger process and the exposure process and reach the development roller 4 have a negative polarity charge.

The principle for recovering the toners 10 reaching the development roller 4 in the above stated manner in the development roller 4 will be explained hereinafter.

The developer unit 9 used in the image forming apparatus according to the present invention employs a contact type mon-magnetic single component toner development system. In this development system, toners 10 having the negative electric charge are provided by directly sandwiching them between the surface of the photoconductor 1 and the surface of the development roller 4 without the existence of magnetic powders.

Herein, whether the sandwiched toners 10 are attracted toward the face of the photoconductor 1 or toward the face of the development roller 4 depends on the direction of the electrostatic force acting on the toners 10. The largeness and the direction of the electrostatic force are determined in accordance with the potential difference ΔV0, the above stated potential difference ΔV0 representing the surface potential VP of the photoconductor 1 subtracted from the potential VR applied to the development roller 4.

FIG. 7 shows a relationship between the potential difference ΔV0 and the amount m0 of the toners 10 which are attracted to the face of the photoconductor 1. When the potential difference ΔV0 become larger than about 0 V toward the negative side, the toners 10 are attracted toward the face of the photoconductor 1 as part of the development process.

Besides, as the potential difference ΔV0 becomes larger than about −100 V toward the positive side, the toners 10 are attracted toward the face of the development roller 14 as part of the recovery process.

In the image forming apparatus according the present invention, during the printing operation, the potential VR applied to the development roller 4 is −300 V degree, the surface potential VP of the photoconductor 1 is −600 V degree at the non-exposure portion and is −80 V degree at the exposure portion. As a result, the potential difference ΔV0 is −600 v degree at the non-exposure portion and −220 V degree at the exposure portion.

As stated above, in the image forming apparatus according to the present invention, since the development operation at the exposure portion and the recovery operation at the non-exposure portion are carried out at the same time, the toners 10 discharged to the photoconductor 1 by the above stated cleaner unit 17 are recovered in the interior portion of the developer unit 9 in parallel by the development operation.

In this case, the toners 10 at the exposure portion are not recovered in the developer unit 9; however, since the exposure portion is a portion in which an image is formed by the toners 10, the non-recovered toners 10 are transferred to the printing sheet 12 at the next transfer process in company with the newly developed toners 10, so that a problem does not occur.

As stated above, during the printing operation, the toners 10 recovered in the cleaner unit 17 are successively re-discharged to the photoconductor 1. In comparison with the case of only use of the cleaning brush 44, the accumulation of the toners 10 on the cleaning brush 44 is lessened and the lowering of the cleaning performance of the image forming apparatus over a long period of practical use will hardly occur. However, in the image forming apparatus according to the present invention, so as to further lessen the cleaning performance, the recovery operation time for increasing the cleaning performance of the toners 10 to the developer unit 9 after the printing operation is provided.

Next, the operation of this embodiment of the image forming apparatus according to the present invention during recovery of the toners will be explained.

In the image forming apparatus according to the latter embodiment of the present invention, as shown in FIG. 9, at the time of completion of the printing motion the power supplies 32 and 33, respectively connected to the charger unit 2 and the transfer unit 11, are turned "off" and at the same time the polarity switching unit 8 connected to the development roller 4 is operated, so that the bias applied to the development roller 4 is changed over to the positive polarity.

In the image forming apparatus according to the present invention, a voltage of 300 V is applied. Further, at this time, in accordance with the potential applied to the cleaning brush 44, the polarity switching unit 16, for connecting the cleaning brush 44 to the power supply 15, is operated, and the applied bias polarity is changed over to the negative polarity.

Further, although not shown in figure, immediately after the bias polarity is applied to the development roller 4 during one rotation of the photoconductor 1, the entire surface of the photoconductor 1 is exposed by the exposure unit 3 and the surface potential of the photoconductor 1 reaches the vicinity of a potential of 0 V.

In the above stated series of operations, in the cleaner unit 17, the bias potential applied to the cleaning brush 44 becomes negative in polarity, the reversal polarity characteristic of the toners 10 automatically stops, and further the applied bias and the polarity of the toners 10 have the same polarity. After the toners 10 are discharged to the photoconductor 1, leaving the negative polarity as it is, they are recovered in the developer unit 9.

In this case, since the toners 10 are directly discharged from the cleaning brush 44 without passing through a reversal in polarity, the toners 10 during the recovery process are discharged faster than during the printing process.

Further, in the whole region extending between the development roller 4 and the photoconductor 1 since the voltage difference $\Delta V0$ is 300 V, the recovery performance of the toners 10 from the photoconductor 1 increases and the whole region of the photoconductor 1 contributes to the recovery of the toners 10, thereby the recovery efficiency during the recovery process of the image forming apparatus further increases in comparison with that of the printing process.

However, in this embodiment of the image forming apparatus according to the present invention, among the toners 10 which have stayed in the cleaning brush 44 during the recovery process, the positively charged toners 10 are not discharged.

Further, in the initial period of the recovery process, the toners 10 which have adhered to the development roller 4 are not sufficiently charged; and therefore, since some positively charged toners 10 are discharged, the above stated positively charged toners 10 are recovered to the cleaning brush 44, and in the cleaner unit 17, the positive polarity toners 10 tend to increase to some degree.

As a result, in this embodiment of the image forming apparatus according to the present invention, a process of discharging the positively charged toners 10 in the cleaner unit 17 is added.

As shown in FIG. 9, during the recovery process, when the discharge timing of the positively charged toners 10 is reached, the power supply 32 connected to the charger unit 2 is turned "on", and accompanying this, the bias applied to the cleaning brush 44 becomes positive.

In this case, the reversal polarity characteristic promoting member 18 is supplied with a potential which is the same potential as the bias potential applied to the cleaning brush 44 by the applied potential switching unit 35. As a result, the toners 10 are discharged from the cleaning brush 44 to the photoconductor 1, leaving the positive polarity as it is.

As stated above, the toners 10 discharged as positive polarity toners 10 from the cleaner unit 17 to the photoconductor 1 are caused to have a negative polarity the charger unit 2, similar to the printing operation. Further, in order to apply a positive polarity bias to the development roller 4, the toners 10 positively charged on the photoconductor 1 are recovered in the developer unit 9 with a higher efficiency during the recovery operation than during the printing operation.

Employing the image forming apparatus constituted above, the construction of the image forming apparatus can be simplified and the image forming apparatus can be constituted be compact. At the same time, since the toners 10 are finally recovered in the developer unit 9, it is possible to reuse the toners, and so the waste toners is avoided.

Further, even when the printing operation is carried out by continuously feeding the printing sheet 12, since the toners 10 are gradually discharged from the cleaner unit 17 during the image forming operation at the same time, a lowering of the cleaning performance of the image forming apparatus with hardly occur even with an increase in the accumulated amount of toners 10 on the cleaning brush 44; as a result, an image forming apparatus which is able to withstand a long period of practical use can be provided.

According to the present invention, as stated above, it is unnecessary to provide the bias cleaner unit with a metal roller for rotating and contacting a brush roller, a blade plate for fixing and contacting to the metal roller, and a container for receiving the toners scratched by the blade plate. As a result, it is possible to provide a compact size image forming apparatus of simplified construction.

Further, since the toners are finally recovered in the developer unit, it is possible to reuse the toners, thereby a waste of toners does not occur. Further, in a case where the passing through of the printing sheet during the printing operation is carried out simultaneously with the image forming process, since the toners are gradually discharged from the cleaner unit, a lowering of the cleaning performance of the image forming apparatus due to an increase in the accumulated amount of the toners on the cleaning brush will hardly occur, and thereby an image forming apparatus which is able to withstand a long period of use can be provided.

I claim:

1. An image forming apparatus comprising:

a charger unit for uniformly charging a surface of an image bearing body;

an exposure unit for light-irradiating said charged surface of said image bearing body and for forming an electrostatic latent image thereon;

a developer unit having a development roller for supplying toners having a predetermined electric charge on said electrostatic latent image to form a visual toner image;

a transfer unit for transferring said visual toner image onto a recording medium; and a cleaner unit for cleaning residual toners which have remained on said image bearing body after the transfer of said visual toner image to said recording medium, said cleaner unit having means for reversing an electric charge polarity of said residual toners present on said image bearing body and means for reversing an electric charge polarity of recovered toners present in said cleaner unit.

2. The image forming apparatus according to claim 1, wherein:

said cleaner unit has means for recovering said residual toners from said image bearing body and, after reversal of said electric charge polarity of said recovered residual toners, for transferring said toners having a reversed electric charge polarity to said image bearing body; and said developer unit has means for recovering residual toners which are carried on said image bearing body which are reversed the electric charge polarity using by said development roller.

3. The image forming apparatus according to claim 2, wherein:

in said cleaner unit, at least during an image nonforming period, one of the cleaning of said residual toners present on said image bearing body and the reversing of the electric charge polarity of said residual toners is stopped, and a transferring of said residual toners to said surface of said image bearing body is carried out.

4. The image forming apparatus according to claim 1, wherein:

said cleaner unit has means, operative at least during an image forming period, for recovering residual toners from said image bearing body and for transferring said residual toners to said image bearing body after the electric charge polarity thereof has been reversed.

5. The image forming apparatus according to claim 1, wherein:

said cleaner unit is a bias cleaner which is able to apply a potential having different polarities.

6. The image forming apparatus according to claim 1, wherein:

said cleaner unit is a bias cleaner; and at least during an image formation a bias polarity applied to said cleaner unit is the same electric charge polarity of said residual toners which are supplied from said developer unit to said image bearing body.

7. The image forming apparatus according to claim 1, wherein:

the image forming apparatus further comprises an electric charge polarity changing means, and said electric charge polarity changing means is operative, at least during image formation, to apply in said cleaner unit a different electric charge polarity to said residual toners which are supplied from said developer unit to said image bearing body.

8. The image forming apparatus comprising:

a charger unit for uniformly charging a surface of an image bearing body;

an exposure unit for light-irradiating said charged surface of said image bearing body and for forming an electrostatic latent image thereon;

a developer unit having a development roller for supplying toners having a predetermined electric charge on said electrostatic latent image to form a visual toner image;

a transfer unit for transferring said visual toner image onto a recording medium; and a cleaner unit for cleaning residual toners which have remained on said image bearing body after the transfer of said visual toner image to said recording medium said cleaner unit having means for reversing an electric charge polarity of said residual toners present on said image bearing body;

wherein:

said cleaner unit has means for recovering said residual toners from said image bearing body and, after reversal of said electric charge polarity of said recovered residual toners, for transferring said toners having a reversed electric charge polarity to said image bearing body;

said developer unit has means for recovering residual toners which are carried on said image bearing body which are reversed the electric charge polarity using by said development roller;

in said cleaner unit, at least during an image nonforming period, one of the cleaning of said residual toners present on said image bearing body and the reversing of the electric charge polarity of said residual toners is stopped, and a transferring of said toners to said surface of said image bearing body is carried out; and the speed of transfer of said residual toners from said cleaner unit to said image bearing body during an image non-forming period is larger than the speed of said transfer residual toners from said cleaner unit to said image bearing body during an image forming period.

9. The image forming apparatus comprising:

a charger unit for uniformly charging a surface of an image bearing body;

an exposure unit for light-irradiating said charged surface of said image bearing body and for forming an electrostatic latent image thereon;

a developer unit having a development roller for supplying toners having a predetermined electric charge on said electrostatic latent image to form a visual toner image;

a transfer unit for transferring said visual toner image onto a recording medium;

a cleaner unit for cleaning residual toners which have remained on said image bearing body after the transfer of said visual toner image to said recording medium said cleaner unit having means for reversing an electric charge polarity of said residual toners present on said image bearing body;

wherein:

said cleaner unit has means for recovering said residual toners from said image bearing body and, after reversal of said electric charge polarity of said recovered residual toners, for transferring said toners having a reversed electric charge polarity to said image bearing body;

said developer unit has means for recovering residual toners which are carried on said image bearing body which are reversed the electric charge polarity using by said development roller; and said cleaner unit is selectively connected to a power supply for supplying an electric current for reversing the electric charge of said residual toners.

10. The image forming apparatus comprising:

a charger unit for uniformly charging a surface of an image bearing body;

an exposure unit for light-irradiating said charged surface of said image bearing body and for forming an electrostatic latent image thereon;

a developer unit having a development roller for supplying toners having a predetermined electric charge on said electrostatic latent image to form a visual toner image;

a transfer unit for transferring said visual toner image onto a recording medium; and a cleaner unit for cleaning residual toners which have remained on said image bearing body after the transfer of said visual toner image to said recording medium said cleaner unit having means for reversing an electric charge polarity of said residual toners present on said image bearing body;

wherein:

said cleaner unit has means for recovering said residual toners from said image bearing body and, after reversal of said electric charge polarity of said recovered residual toners, for transferring said toners having a reversed electric charge polarity to said image bearing body;

said developer unit has means for recovering residual toners which are carried on said image bearing body which are reversed the electric charge polarity using by said development roller; and said cleaner unit has a cleaning roller for contacting said surface of said image bearing body and a blade plate for tribo-electrically charge reversing the charge polarity of said toners which come into contact with said cleaning roller and adhere to said cleaning roller.

11. An image forming apparatus comprising:

a charger unit for uniformly charging a surface of an image bearing body;

an exposure unit for light-irradiating said charged surface of said image bearing body and for forming an electrostatic latent image thereon;

a developer unit having a development roller for supplying toners having a predetermined electric charge on said electrostatic latent image to form a visual toner image;

a transfer unit for transferring said visual toner image onto a recording medium; and a cleaner unit for cleaning residual toners which have remained on said image bearing body after transfer of said visual toner image onto said recording medium wherein:

said cleaner unit has recovery means for recovering residual toners carried on said image bearing body, reversal means for reversing an electric charge polarity of recovered residual toners and means for reversing an electric charge polarity of recovered toners present in said cleaner unit, and discharge means for transferring residual toners, whose electric charge polarity has been reversed, to said image bearing body.

12. The image forming apparatus according to claim 11, wherein:

said developer unit has a recovery unit for recovering from said image bearing body toners whose electric charge polarity has been reversed by said reversal means and which have been transferred to said image bearing body by said discharge means of said cleaner unit.

13. An image forming apparatus comprising:

a charger unit for uniformly charging a surface of an image bearing body;

an exposure unit for light-irradiating said charged surface of said image bearing body and for forming an electrostatic latent image thereon;

a developer unit having a development roller responsive to a bias voltage of a first polarity for supplying toners having a predetermined electric charge on said electrostatic latent image to form a visual toner image, said development roller being responsive to a bias voltage of a second polarity for attracting residual toners carried on said image bearing body so as to transfer said residual toners from said image bearing body into said developer unit;

a transfer unit for transferring said visual toner image onto a recording medium;

a cleaner unit for cleaning residual toners which have remained on said image bearing body after the transfer of said visual toner image onto said recording medium, said cleaner unit further having a cleaning roller and further having means for reversing an electric charge polarity of recovered toners present in said cleaner unit; and bias power supply means for supplying a bias potential at said first polarity during a printing time to said cleaning roller and said development roller and for supplying a bias potential at said second polarity to said development roller during a non-printing time;

said cleaner unit further including a reversal charge promoting member for reversing the electric charge polarity of residual toners carried on said image bearing body whereby the electric charge polarity of cleaner unit is reversed, and in company with the rotation of said image bearing body, the residual toners carried on said image bearing body are introduced into said developer unit and recovered in said developer unit.

14. An image forming apparatus comprising:

a charger unit for uniformly charging a surface of an image bearing body;

an exposure unit for light-irradiating said charged surface of said image bearing body and for forming an electrostatic latent image thereon;

a developer unit having a development roller for supplying toners having a predetermined electric charge on said electrostatic latent image to form a visual toner image;

a transfer unit for transferring said visual toner image onto a recording medium; and a cleaner system having a polarity reversing unit separated from said image bearing body, said cleaner system removing residual toner particles remaining on said image bearing body after the transfer of said visual toner image to said recording medium, reversing an electric charge polarity of said residual toner particles at the separated said polarity reversing unit, and returning ones of said residual toner particles having had a polarity thereof reversed back to said image bearing body, wherein said removing and said returning processes are conducted concurrently.

* * * * *